313-414 SR
8/26/86 XR 4,608,515

United States Patent [19]

Chen

[11] Patent Number: 4,608,515

[45] Date of Patent: Aug. 26, 1986

[54] CATHODE-RAY TUBE HAVING A SCREEN GRID WITH ASYMMETRIC BEAM FOCUSING MEANS AND REFRACTION LENS MEANS FORMED THEREIN

[75] Inventor: Hsing-Yao Chen, West Hempfield Township, Lancaster County, Pa.

[73] Assignee: RCA Corporation, Princeton, N.J.

[21] Appl. No.: 729,163

[22] Filed: Apr. 30, 1985

[51] Int. Cl.[4] ..... H01J 29/51

[52] U.S. Cl. ..... 313/412; 313/414

[58] Field of Search ..... 313/414, 412, 413, 447, 313/448, 449, 458

[56] References Cited

U.S. PATENT DOCUMENTS

| | | | |
|---|---|---|---|
| B 381,074 | 1/1975 | Hasker et al. | 313/448 |
| 3,497,763 | 2/1970 | Hasker | 315/31 |
| 3,771,002 | 11/1973 | Standaart . | |
| 3,772,554 | 11/1973 | Hughes . | |
| 3,866,081 | 2/1975 | Hasker et al. | 313/449 |
| 4,234,814 | 11/1980 | Chen et al. | 313/412 |
| 4,242,613 | 12/1980 | Brambring et al. | 313/447 |
| 4,251,747 | 2/1981 | Burdick | 313/348 |
| 4,272,700 | 6/1981 | Collins | 313/458 |
| 4,366,414 | 12/1982 | Hatayama et al. | 313/458 X |
| 4,388,552 | 6/1983 | Greninger | 313/414 |
| 4,406,970 | 9/1983 | Hughes | 313/414 |
| 4,513,222 | 4/1985 | Chen | 313/412 |
| 4,520,292 | 5/1985 | Van Hekken et al. | 313/412 |
| 4,523,123 | 6/1985 | Chen | 313/412 |
| 4,558,253 | 12/1985 | Bechis et al. | 313/414 |

FOREIGN PATENT DOCUMENTS

| | | |
|---|---|---|
| 58-59534 | 8/1983 | Japan . |
| 1230109 | 4/1971 | United Kingdom . |

*Primary Examiner*—Stewart J. Levy
*Assistant Examiner*—Joseph W. Roskos
*Attorney, Agent, or Firm*—Eugene M. Whitacre; Dennis H. Irlbeck; Vincent J. Coughlin, Jr.

[57] ABSTRACT

The asymmetric beam focusing slot provides a two-part crossover of the electron beams. The slot has a length greater than the spacing between the outer apertures and a width greater than the diameter of the apertures. The screen grid also has an improved refraction lens which comprises a transversely disposed recessed portion including a substantially rectangularly-shaped central portion and substantially triangularly-shaped end parts. The refraction lens provides a compensating field between the screen grid and the main electron lens to offset any changes in the main electron lens caused by variations in the focus voltage in the main electron lens. The recessed portion has a length, extending in the plane of the electron beams, at least coextensive with the length of the slot, and a width, extending substantially orthogonal to the plane of the electron beams, substantially greater than the width of the slot. The recessed portion is surrounded by a peripheral rim which conforms to the shape of the recessed portion. The central part of the peripheral rim is remote from the center aperture, and the triangularly-shaped end parts of the rim are in proximity to the outer apertures, thereby affecting the electrostatic field in the vicinity of the outer apertures by tilting the field lines within the recessed portion.

5 Claims, 9 Drawing Figures

CATHODE-RAY TUBE HAVING A SCREEN GRID WITH ASYMMETRIC BEAM FOCUSING MEANS AND REFRACTION LENS MEANS FORMED THEREIN

BACKGROUND OF THE INVENTION

The present invention relates to cathode-ray tubes, and particularly to color cathode-ray tubes of the type useful in color display systems. The invention is especially applicable to self-converging tube-yoke combinations with cathode-ray tubes of the type having plural-beam inline guns disposed in a horizontal plane.

An inline electron gun is one designed to generate a trio of electron beams in a common plane and to direct the beams along convergent beam paths to a small area spot on a phosphor screen. A self-converging yoke is one designed with specific field nonuniformities which maintain the beams converged throughout the raster scan without the need for convergence means other than the yoke itself.

In one type of inline electron gun, such as that shown in U.S. Pat. No. 3,772,554, issued to R. H. Hughes on Nov. 13, 1973, a main electron lens for focusing the electron beam is formed between two electrodes referred to as the first and second accelerating and focusing electrodes. These electrodes include two cup-shaped members having the bottoms of the members facing each other. Three apertures are included in each cup bottom to permit passage of three electron beams. In such electron guns, static convergence of the other beams with respect to the center beam is usually attained by offsetting the outer apertures in the second focusing electrode with respect to the outer apertures in the first focusing electrode.

It has been noted that the horizontal beam landing locations of the outer electron beams, in color picture tubes having the above-described electron gun, change with changes in the focus voltage applied to the electron gun. It therefore is desirable to improve such inline electron guns to eliminate, or at least reduce, this horizontal convergence sensitivity to focus voltage changes.

Additionally, there has been a general trend toward inline color picture tubes with greater deflection angles (angles in excess of 90°) in order to provide shorter tubes. In such tubes, it has been found that the electron beams become excessively distorted as they are scanned toward the outer portions of the screen. Such distortions are commonly referred to as flare and appear on the screen of the tube as an undesirable low intensity tail or smear extending from a desirable intense core or spot. Such flare distortions are due, at least in part, to the effects of the fringe portions of the deflection field of the yoke on the beam as it passes through the electron gun, and to the nonuniformities in the yoke deflection field itself.

When the yoke's fringe field extends into the region of the electron gun, as is usually the case, the beams may be deflection slightly off axis and into a more aberrated portion of an electron lens of the gun. The result is frequently a flare distortion of the electron beam spot which extends from the spot toward the center of the screen. This condition is particularly troublesome in self-converging yokes having a toroidal vertical deflection coil, because of the relatively strong fringing of toroidal type coils.

Self-converging yokes are designed to have a nonuniform field in order to increasingly diverge the beams as the horizontal deflection angle increases. This nonuniformity also causes vertical convergence of the electrons within each individual beam. Thus, the beam spots are overconverged at points horizontally displaced from the cente of the screen, causing a vertically extending flare both above and below the core of the beam spot.

The vertical flare due to both the effects of the yoke's fringe field in the region of the gun and to the nonuniform character of the yoke field itself is an undesirable condition which contributes to poor resolution of a displayed image on the edge and corners of the screen.

U.S. Pat. No. 4,513,222, issued to Chen on Apr. 23, 1985, and copending U.S. patent application Ser. No. 492,044, filed on May 6, 1983, by Chen and now U.S. Pat. No. 4,523,123 and assigned to the assignee of the present invention, each disclose screen grid structures for simultaneously reducing both the horizontal sensitivity of the outer beams of the inline electron gun to focus voltage changes and the vertical flare distortion of the electron beam spot. The disclosed structures utilize a plurality of rectangular slots aligned with the screen grid apertures and formed in the surface of the screen grid facing the control grid to create an astigmatic field that produces underconvergence of the electron beam in the vertical plane only, to compensate for the vertical flare distortion. Such a slot structure is described in U.S. Pat. No. 4,234,814, issued to Chen et al. on Nov. 18, 1980.

The screen grid structure disclosed in U.S. Pat. No. 4,513,222 utilizes a pair of reconvergence slots formed on the first focusing electrode side of the screen grid to compensate for the offset refraction within the main lens of the electron gun due to focus voltage changes. The reconvergence slots are formed closely to and inwardly from the outer apertures in the screen grid and cause a refraction of the electrostatic beam path between the screen grid and the first focusing electrode.

The screen grid structure disclosed in the copending patent application Ser. No. 492,044 utilizes a pair of circular depressions formed asymmetrically about the outer apertures on the first focusing electrode side of the screen grid to reduce the horizontal convergence sensitivity, within the main lens of the electron gun, due to focus voltage changes. The circular depressions are precisely displaced toward the center aperture of the screen grid.

The aforedescribed structures have a plurality of rectangular slots aligned with the screen grid apertures on one side of the screen grid to compensate for vertical flare, and either reconvergence slots, formed inwardly of the outer apertures, or circular depressions, formed asymmetrically about the outer apertures, on the opposite side of the screen grid, to reduce the horizontal convergence sensitivity of the outer beams due to focus voltage changes. Such structures require precise placement of the rectangular slots as well as the reconvergence slots and circular depressions relative to the apertures and are, therefore, expensive to manufacture. Thus, a screen grid, which corrects both vertical flare and horizontal convergence sensitivity to focus voltage change and is easily and inexpensively manufactured, is desirable.

Copending U.S. patent application Ser. No. 492,437, filed on May 6, 1983, by van Hekken et al. and now U.S. Pat. No. 4,520,292, discloses a screen grid having a refraction lens comprising a recessed portion formed in the surface facing the main electron lens. A peripheral rim, which makes an angle of about 63° with the surface of the electrode, surrounds the recessed portion through which the screen grid apertures are formed. The refraction lens provides a correction for the horizontal convergence sensitivity to focus voltage change. In order to correct for vertical flare in tubes have a deflection angle in excess of 90°, a slot is superposed on each of the apertures of the control grid on the side facing the screen grid. The slots are symmetrically disposed about the control grid apertures and extend in a direction perpendicular to the plane of the apertures of the inline gun. Such a control grid structure is disclosed in copending U.S. patent application Ser. No. 485,860 by Bechis et al. on Apr. 18, 1983 and now U.S. Pat. No. 4,558,253. The aforementioned structure requires precise forming of the slots in the control grid and of the recessed portion in the screen grid in order to reduce vertical flare and horizontal sensitivity to focus voltage change, respectively. The precise forming of two grids, the control grid and the screen grid, of the electron gun is even more expensive than the previously described screen grid structures providing both flare reduction and correction of horizontal convergence sensitivity to changes in focus voltage.

SUMMARY OF THE INVENTION

A cathode-ray tube has an inline electron gun for projecting three electron beams, including a center beam and two outer beams, along beam paths onto a screen. The gun comprises three cathodes for generating the electron beams and a control grid, a screen grid and a main electron lens arranged successively in alignment with the cathodes for focusing the electron beams. The control grid, the screen grid and the main electron lens each have three spaced-apart, aligned apertures, comprising a center aperture and two outer apertures, disposed in a plane for passing the electron beams. The screen grid has a functional grid region which includes the screen grid apertures, asymmetric beam focusing means and refraction lens means. The screen grid has an improved asymmetric beam focusing means which comprises a transversely disposed rectangularly-shaped slot. The slot has a length greater than the spacing between the outer apertures and a width greater than the diameter of the apertures. The screen grid also has an improved refraction lens means which comprises a transversely disposed recessed portion including a substantially rectangularly-shaped central portion and substantially triangularly-shaped end parts. The recessed portion has a length, extending in the plane of the electron beams, at least coextensive with the length of the slot, and a width, extending substantially orthogonal to the plane of the electron beams, substantially greater than the width of the slot. The recessed portion is surrounded by a peripheral rim which conforms to the shape of the recessed portion. The central part of the peripheral rim is remote from the center aperture, and the triangularly-shaped end parts of the rim are in proximity to the outer apertures, thereby affecting the electrostatic field in the vicinity of the outer apertures by tilting the field lines within the recessed portion.

DETAILED DESCRIPTION OF THE PREFERRED EMBODIMENTS

Figure 1:
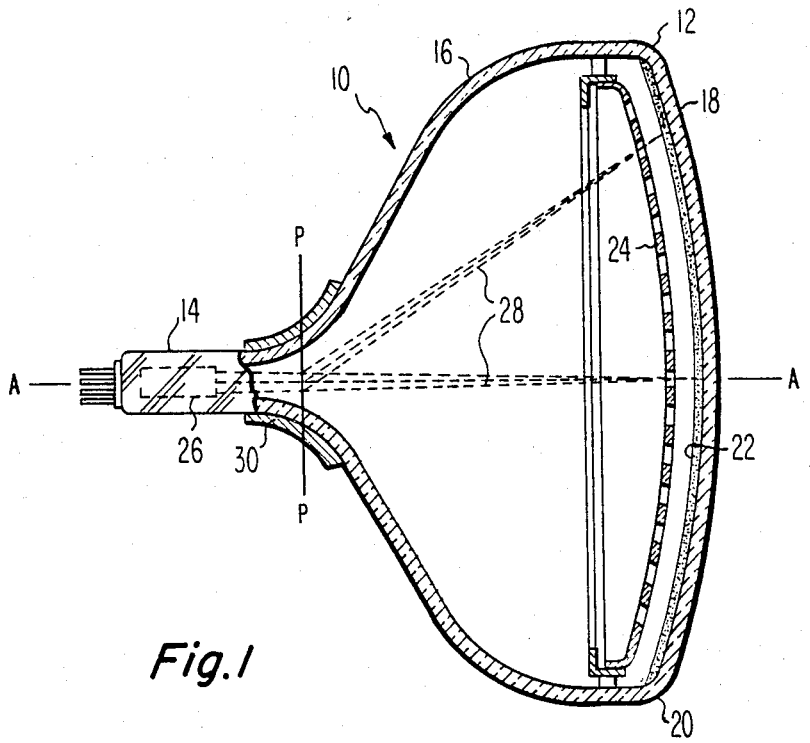
FIG. 1 is a plan view, partly in axial section, of a cathode-ray tube embodying the present invention.

FIG. 1 is a plan view of a rectangular color cathode-ray tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). Alternately, the screen could be a dot screen as is known in the art. A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct a trio of electron beams 28 along spaced coplanar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1.

Figure 2:
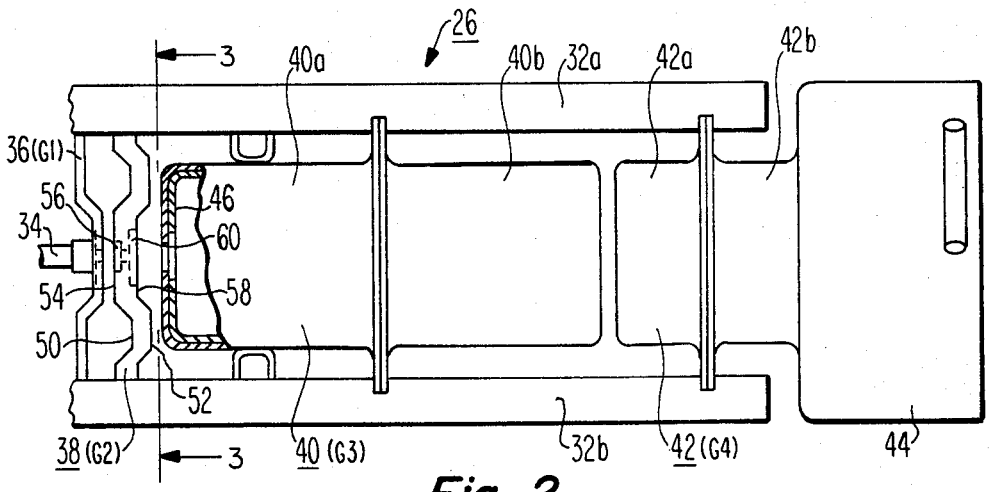
FIG. 2 is a partial axial section view of the electron gun showed in dashed lines in FIG. 1.

FIG. 2 provides a partial axial section view of the improved electron gun 26. The gun comprises two glass support rods **32*a*, 32*b* on which the various gun electrodes are disposed in parallel relationship. The electrodes of the electron gun 26 include three equally spaced-apart coplanar cathodes 34 (only one of which is visible in the side view of FIG. 2), a beam forming region comprising a control grid 36 (G1) and a screen grid 38 (G2), and a main electron lens comprising a first focusing electrode 40 (G3) and a second focusing electrode 42 (G4). A shield cup 44 is attached to one end of the G4 electrode 42**.

Each of the cathodes 34 is aligned with respective coplanar apertures in the G1, G2, G3 and G4 electrodes to allow passage therethrough of electrons emitted by the cathodes. The apertures comprise a center aperture and two outer apertures. The electons are formed into the aforementioned trio of beams 28 by respective electrostatic beam-forming lenses established between opposing apertured regions of the G1 and G2 electrodes 36 and 38, which are maintained at different potentials (e.g., 0 volts and between +500 and +1000 volts, respectively). Focusing of the beams at the screen 22 is primarily effected by a main electrostatic focus lens formed between adjoining regions of the G3 and G4 electrodes 40 and 42. By way of illustration, the G3 electrode 40 is maintained at a focus potential (e.g., +6500 volts), which is about 26% of the potential (e.g., +25,000 volts) applied to the G4 electrode 42.

The G3 electrode 40 comprises an assembly of two cup-shaped elements **40*a*, 40*b*, with open ends abutting. A magnetic insert 46 formed of a magnetizable material (e.g., a nickel-iron alloy of 52% nickel and 48% iron) having a high permeability relative to the permeability of the material (e.g., stainless steel) employed for the focus electrodes, is disposed within the G3 electrode 40*a* adjacent to the G2 electrode 38 to shield the beam path 28 in the prefocus region from the effects of the magnetic fields. The G4 electrode 42 also comprises an assembly of two cup-shaped elements 42*a*, 42*b*, with open ends abutting. The closed end of element 42*b* abutts the apertured closed end of the shield cup 44**.

As so far described, the improved electron gun 26 is similar to the electron gun described in copending U.S. patent application Ser. No. 343,734, filed by Morrell et al. on Jan. 29, 1982, and assigned to the assignee of the present patent application. The Morrell et al. copending patent application is incorporated by reference herein for the purpose of disclosure.

The improved electron gun 26 of the present application differs from the aforementioned electron gun of the Morrell et al. patent application in that G1 electrode 36 of the present gun is coined to provide an effective thickness in the region of the apertures of 0.1 mm (4 mils) which is 27.3 percent thinner than the G1 electrode of the Morrell et al. structure which is coined to provide an effective thickness in the region of the apertures of 0.14 mm (5.5 mils). This provides a smaller spot size at the screen at high current. Additionally, the apertures of the G1 electrode 36 have a diameter of 0.53 mm (21 mils) compared to the 0.615 mm (25 mils) diameter apertures for the Morrell et al. structure. The present structure also eliminates the vertical slot interposed on each of the G1 apertures in the prior art Morrell et al. structure.

With reference to FIGS. 2–5, the novel G2 electrode 38 has a first surface 50, directed toward the G1 electrode 36, and an oppositely disposed second surface 52. The first surface 50 has a functional grid region 54 in which is formed an asymmetric beam focusing means comprising a transversely disposed rectangularly-shaped slot 56 which is aligned in the plane of the three cathodes 34. The second surface 52 also has a functional grid region 58 in which is formed refraction lens means comprising, inter alia, a transversely disposed recessed portion 60.

Figure 3:
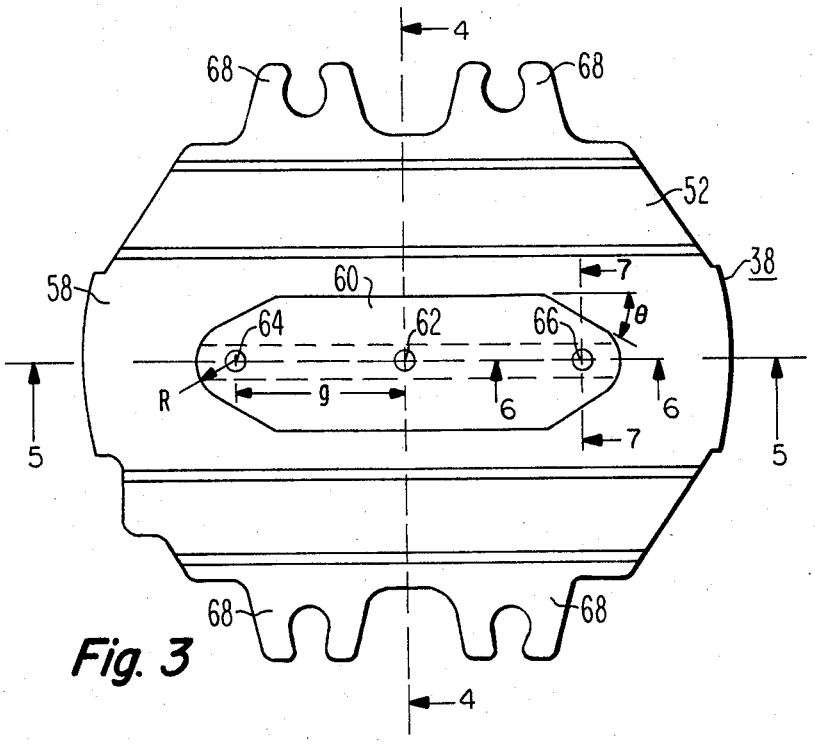
FIG. 3 is an enlarged elevational view of the novel screen grid taken along line 3—3 of FIG. 2.
Figure 4:
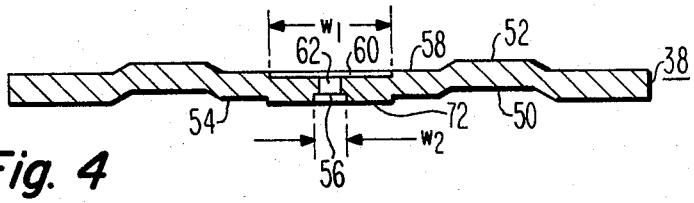
FIG. 4 is an enlarged section view of the novel screen grid taken along line 4—4 of FIG. 3.
Figure 5:
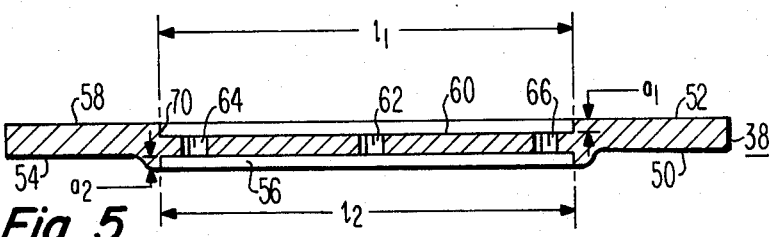
FIG. 5 is an enlarged section view of the novel screen grid taken along line 5—5 of FIG. 3.

As shown in FIGS. 3–5, the substantially circularly-shaped screen grid apertures include a center aperture 62 and two outer apertures 64 and 66 which extend through the screen grid 38 and interconnect the slot 56 formed in the first surface 50 with the recessed portion 60 formed in the second surface 52. The circularly-shaped screen grid apertures 62, 64 and 66 provide symmetric pre-focusing of the beams entering the main electron lens. A pair of securing members 68 extend outwardly from two oppositely disposed sides of the G2 electrode 38 to facilitate attachment to the support rods **32*a*, 32*b***.

A peripheral rim 70, which conforms to the shape of the recessed portion 60 and is substantially perpendicular thereto, surrounds the recessed portion and extends between the recessed portion and the functional grid region 58. The recessed portion 60 and the peripheral rim 70, comprising the refraction lens means, are symmetric with respect to the center aperture 62 but asymmetric with respect to the outer apertures 64 and 66.

In the preferred embodiment, the screen grid apertures 62, 64, 66 have a diameter of 0.53 mm (21 mils). The lateral spacing, "g", between adjacent pairs of apertures is 5.08 mm (200 mils) center-to-center. As shown in FIGS. 4 and 5, the recessed portion 60 has a length, "$l_1$", extending in the plane of the electron beams, of 12.50 mm (492 mils) and a width, "$w_1$", extending substantially orthogonal to the plane of the electron beam, of 3.81 mm (150 mils), measured at the center aperture 62. The recessed portion 60 extends laterally outwardly about 3.94 mm (155 mils) from opposite sides of the center aperture 62 to form a substantially rectangularly-shaped central part. The ends of the recessed portion 60 form an angle, $\theta$, of about 30° with the horizontal and are, thus, substantially triangularly-shaped with the apex of each of the triangularly-shaped end parts being smoothly curved and having a radius, "R", of about 1.17 mm (46 mils) measured from the center of each of the outer apertures 64, 66. The G2 electrode 38 has an overall thickness of about 0.51 mm (20 mils) which is about 0.21 mm (8 mils) thinner than the G2 electrode described in the aforementioned U.S. patent application Ser. No. 492,437. The depth, $a_1$, of the recessed portion 60 is about 0.15 mm (6 mils) and is formed by a stamping operation that produces a corresponding elevated portion 72, shown in FIG. 4, which extends outwardly from the first surface 50. The transversely disposed, rectangularly-shaped slot 56 formed in the functional grid region 54 of the first surface 50 has a width, "$w_2$", of about 0.71 mm (28 mils). The slot width, $w_2$, is greater than the diameter of the apertures 62, 64, 66 and is disposed symmetrically above and below the apertures. The slot 56 has a length, "$l_2$", of about 12.50 mm (492 mils), which is greater than the spacing between the outer apertures 64 and 66. The length, $l_2$, of the slot 56 is coextensive with the length, $l_1$, of the recessed portion 60 formed in the second surface 52. The slot 56, as described herein, is asymmetrically aligned relative to the apertures 62, 64 and 66 in that the length of the slot, in the vicinity of the apertures is much greater than the width of the slot. The slot 56 has a depth, "$a_2$", of about 0.25 mm (10 mils) and communicates with each of the G2 electrode apertures 62, 64 and 66. While the length, $l_2$, of the slot 56 in the first surface 50 is disclosed as being equal to the length, $l_1$, of the recessed portion 60 in the second surface 52, the slot 56 may, in fact, be longer than the recessed portion in this embodiment without adversely affecting the performance of the asymmetric beam focusing provided by the slot 56, as described hereinafter.

Figure 8:
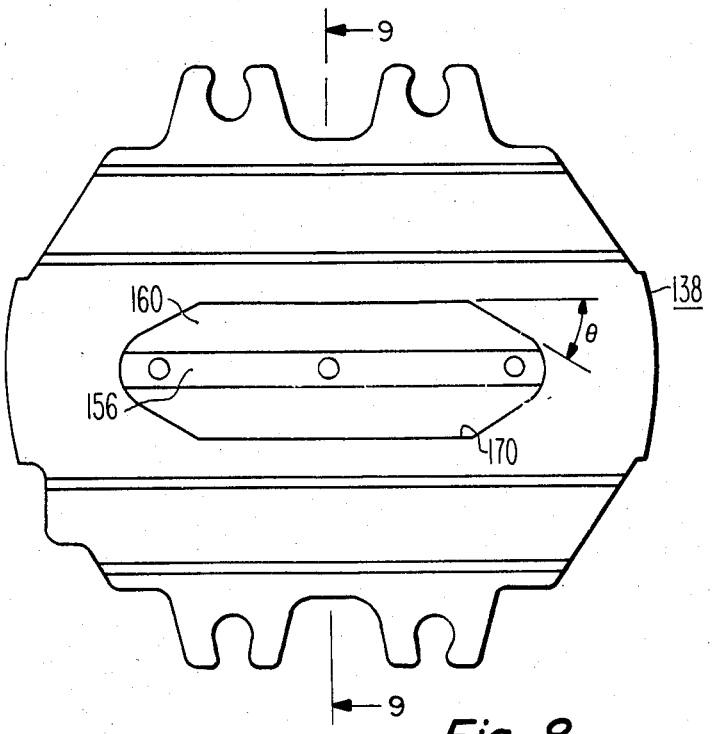
FIG. 8 is an enlarged elevational view of a second embodiment of the novel screen grid.
Figure 9:
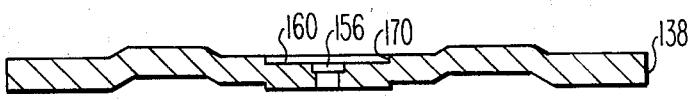
FIG. 9 is an enlarged section view of the second embodiment of the novel screen grid taken along line 9—9 of FIG. 8.

A second embodiment of the present novel G2 electrode 138 is shown in FIGS. 8 and 9. Identical structural elements of the second embodiment are prefexed by the number one. As shown in FIG. 8, the G2 electrode 138 is substantially identical to the G2 electrode 38 except that the asymmetric beam focusing means comprising the substantially rectangular slot 156 is formed on the same side of the G2 electrode as the refraction lens means comprising the recessed portion 160 and the peripheral rim 170. The ends of the slot 156 are smoothly curved to conform to the radii of the apices of the triangular end parts of the recessed portion 160, which for each end is 1.17 mm (46 mils). In all other respects, the G2 electrode 138 is identical to the G2 electrode 38. The G2 electrode 138 is positioned in the electron gun so that the slot 156 and the recessed portion 160 are directed toward the G3 electrode 40.

Figure 6:
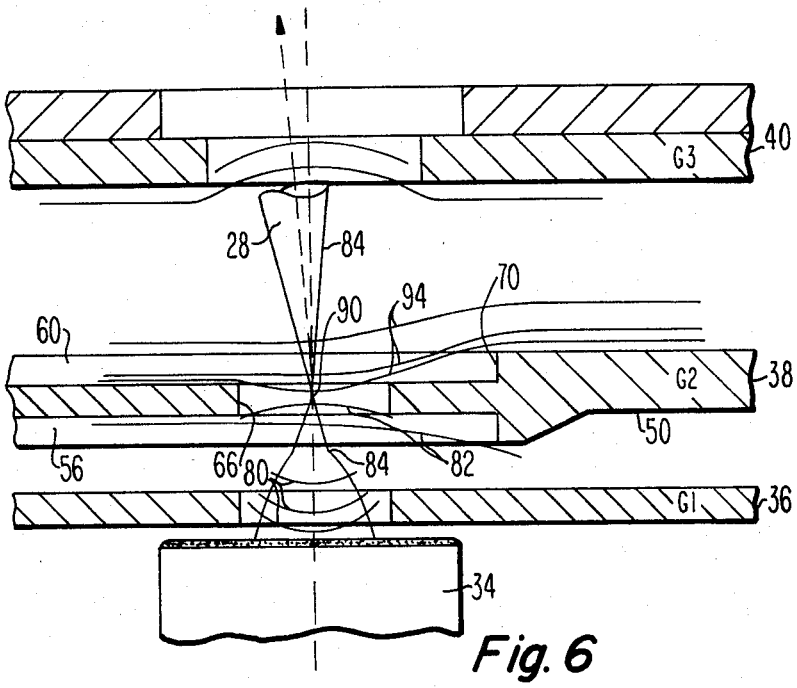
FIG. 6 is an enlarged section, taken along line 6—6 of FIG. 3, illustrating formation of the electron beam in a horizontal plane.
Figure 7:
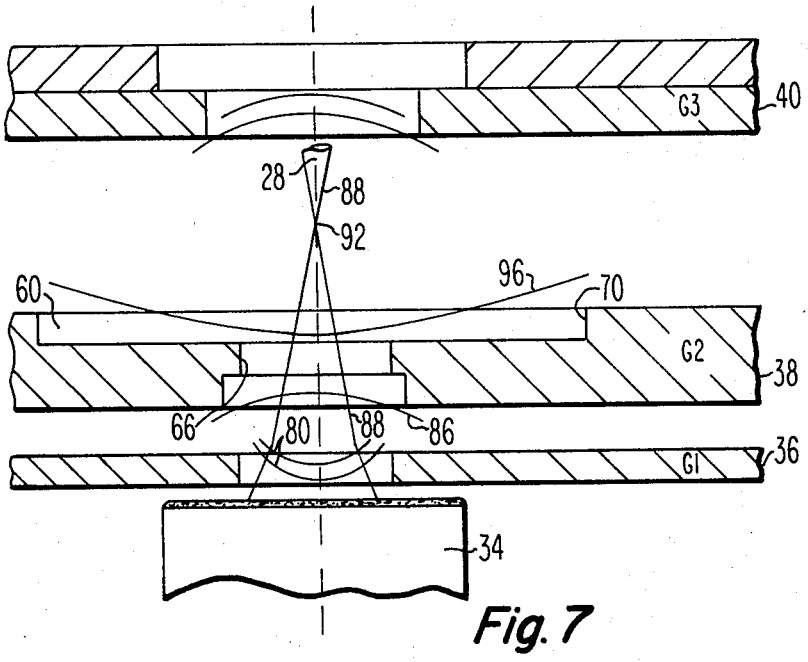
FIG. 7 is an enlarged section, taken along line 7—7 of FIG. 3, illustrating formation of the electron beam in a vertical plane.

THEORY OF OPERATION the operation of the novel electron gun 26 will be described with respect to one of the outer electron beams 28 which passes through the outer G2 electrode aperture 66. The novel G2 electrode 38 includes, in combination, the slot 56 which provides an asymmetric beam focusing means for reducing flare distortion and the recessed portion 60 with the peripheral rim 70 which provides a refraction lens means to reduce the horizontal convergence sensitivity to changes in focus voltage. As illustrated in FIGS. 6 and 7, electrons emitted from the cathode 34 are focused to a crossover by the rotationally symmetric electric field having converging field lines 80 which dip into the circular G1 aperture toward the cathode. As shown in FIGS. 6 and 7, an astigmatic electric field is established at the beam entrance side of the first surface 50 of the G2 aperture 66 because of the rectangular slot 56. This field acts differently on convergent electrons in a horizontal plane than it does on convergent electrons in a vertical plane.

As shown in FIG. 6, diverging field lines 82 of this astigmatic field, which lie in a horizontal plane, produce a slight straightening of the electron beam rays so as to provide a relatively narrow crossover angle. Because of the asymmetry of the slot 56, the field lines 82 are flatter to the left of the aperture 66 than to the right of the aperture; however, because of the small spacing (about 0.23 mm) between the G1 electrode 36 and the G2 electrode 38, this difference is electron optically imperceptible and does not adversely affect the electron beam. The electron trajectories, as illustrated in FIG. 6, show the outermost rays 84 in a horizontal plane. FIG. 7 shows a similar view wherein diverging field lines 86 of the astigmatic field, which lie in a vertical plane, are more sharply curved than the field lines 82 and, thus, produce a stronger field than that produced by the field lines 82. As a result, the outermost electron rays 88 in the vertical plane undergo a greater straightening, and, therefore, converge with an even shallower crossover angle to a crossover farther forward than that experienced by the horizontal rays shown in FIG. 6. The result is a two-part crossover with a first line crossover 90 of the horizontally converging rays and a farther forward line crossover 92 of the vertically converging rays.

The slot 56, which communicates with each of the G2 electrode apertures 62, 64 and 66, thus produces composite beams having horizontally converging rays which are focused to a line, or elongated point, on the phosphor screen of the tube, whereas the vertically converging rays are underfocused and actually converge to a line, or elongated point, beyond the phosphor screen.

Although the electron beam spot at the center of the screen has a greater vertical dimension than horizontal dimension, just the opposite is true of the beam cross-section as it passes through the main focus lens, i.e., between the G3 electrode 40 and the G4 electrode 42, of the gun. There, because of the smaller crossover angle in the vertical plane, the electron beam has a smaller vertical than horizontal dimension. As a result, any deflection of the beam off axis due to the fringing yoke field in the vertical direction does not as severely affect the beam, since the beam does not move as fully into the aberrated portion of the lens. Thus, vertical flare due to the fringing yoke field is reduced.

Moreover, since the composite beam is characterized by underconvergence in the vertical plane, that underconvergence compensates for the vertical overconvergence which the yoke field exerts upon the beam. Accordingly, the vertical flare, both above and below the electron beam in off-center positions on the screen, is significantly reduced.

As shown in FIG. 6, the field lines 94, which lie in the horizontal plane, extend between the G2 electrode 38 and the G3 electrode 40 of the electron gun 26. In the present gun 26, the distance between the G2 electrode 38 and the G3 electrode 40 is of the order of about 1.22 mm. The asymmetric shape and the depth of the recessed portion 60 of electrode 38 as well as the proximity of the peripheral rim 70 to the outer aperture 66 and the voltage difference between the G2 electrode 38 and the G3 electrode 40 produce a refraction lens which affects the electrostatic field in the vicinity of the outer electron beam by tilting the horizontal field lines 94 within the recessed portion 60.

If, for example, the focus voltage on the G3 electrode 40 is made more positive and the potential on the G4 electrode 42 is unchanged, then the G3–G4 main electron lens is weakened, and the outer beams tend to misconverge outwardly. At the same time, the increase in G3 focus voltage relative to the fixed potential on the G2 electrode 38 strengthens the G2–G3 lens action. The electrostatic field formed between the G2 electrode 38 and the G3 electrode 40 is strongly distorted so that the field lines 94 cause the outer electron beam to horizontally converge toward the center electron beam as the beams pass through the apertures in the G2 electrode 38. This case is shown in FIG. 6. The refraction lens means thus compensates for the misconvergence that occurs within the main electron lens.

Likewise, if the G3 focus voltage is made less positive, the G3–G4 main electron lens is strengthened, and the outer beams tend to converge inwardly. Simultaneously, the decrease in the focus voltage of the G3 electrode 40 relative to the fixed potential on the G2 electrode 38 weakens the G2–G3 lens action so that the field lines 94 are less strongly distorted, and the outer electron beams tend to misconverge outwardly from the center beam after the beams pass through the apertures in the G2 electrode 38.

The net effect is that the refraction lens means provides a compensating field between the G2 electrode 38 and the G3 electrode 40 which offsets any changes in the main electron lens, i.e., between the G3 electrode 40 and the G4 electrode 42, caused by focus voltage variations.

As shown in FIG. 7, the field lines 96, which lie in the vertical plane, are symmetric with respect to aperture 66 so that the three electron beams are unperturbed in the vertical direction because of the vertical symmetry of the recessed portion 60 and the substantially greater spacing between the aperture 66 and the peripheral rim 70 in the vertical direction. Thus, the refraction lens means affects only the horizontal convergence of the outer electron beams for changes in focus voltage. The strength of the aforementioned effect is governed by the depth of the recess 60, the radius of the triangular end parts and the field strength between the G2 and G3 electrodes. The field strength is defined as the voltage difference between the G2 and G3 electrodes divided by the distance therebetween. The greater the radius of the triangular end parts, the farther the peripheral rim 70 is removed from the outer apertures 72, and the deeper the recess must be to affect the paths of the electron beams.

A similar effect occurs for the other outer electron beam which passes through the G2 electrode aperture 64.

Since, in the second embodiment, the slot 156 is located at the high voltage side of the G2 electrode 138, the electrons are moving at a higher velocity due to the influence of the voltage on the G3 electrode. Consequently, the asymmetric beam focusing is weaker in the second embodiment than in the aforedescribed embodiment where the slot 56 is formed on the low voltage side of the G2 electrode 38 and where the electrons are traveling at a lower velocity and spending more time in the asymmetric field. The operation of the refraction lens is as described above for the G2 electrode 38.

The present novel G2 electrodes 38 and 138, each of which includes a single asymmetric beam focusing slot 56 and 156, respectively, extending across all three beam forming apertures and aligned with the refraction lens means, are superior to prior art structures, such as those described in U.S. Pat. No. 4,513,222 and copending U.S. patent application Ser. No. 492,044, referenced above, in which a discrete beam focusing slot is formed around each of the apertures. Misalignment of one of the slots in the prior art structures relative to either the aperture associated therewith or to the refraction lens means formed in the opposite surface produces an unwanted misalignment of the electron beam. By forming one asymmetric beam focusing slot which extends across all three apertures and accurately aligns the focusing slot relative to the refraction lens means, the problems encountered in the prior art structures are alleviated.

What is claimed is:

1. In a cathode-ray tube comprising an image screen and an inline electron gun for projecting three electron beams including a center beam and two outer beams along beam paths onto said screen, said gun comprising:

three cathodes for generating the electron beams, a control grid, a screen grid, and a main electron lens arranged successively in alignment with said cathods for focusing said electron beams, said control grid, said screen grid, and said main electron lens each having three spaced-apart, aligned apertures comprising a center aperture and two outer apertures disposed in a plane for passing the electron beams, said screen grid having a functional grid region including the screen grid apertures, asymmetric beam focusing means for reducing flare distortion, and refraction lens means, the improvement wherein said asymmetric beam focusing means comprises a transversely disposed rectangularly-shaped slot, said slot having a length greater than the spacing between the outer screen grid apertures and a width greater than the diameter of the screen grid apertures, and said refraction lens means comprises a transversely disposed recessed portion including a substantially rectangularly-shaped central part and substantially triangularly-shaped end parts, said recessed portion having a length, extending in the plane of said electron beams, substantially coextensive with the length of said slot, and a width, extending substantially orthogonal to said plane of said electron beams, substantially greater than the width of said slot, said recessed portion being surrounded by a peripheral rim which conforms to the shape of said recessed portion, the central part of said peripheral rim being remote from said center aperture and the triangularly-shaped end parts of said rim being in proximity to said outer apertures, thereby affecting the electrostatic field in the vicinity of the outer beam paths by tilting the field lines within said recessed portion.

2. The tube as in claim 1, wherein said slot has a length greater than the length of said recessed portion.

3. The tube as in claim 1, wherein said slot is formed in one side of said screen grid and said recessed portion is formed in the opposite side of said screen grid.

4. The tube as in claim 1, wherein said slot and said recessed portion are formed in the same side of said screen grid.

5. In a cathode-ray tube comprising an image screen and an inline electron gun for projecting three electron beams including a center beam and two outer beams along beam paths onto said screen, said gun comprising:

three cathodes for generating the electron beams, a control grid, a screen grid, and a main electron lens comprising a first focus electrode and a second focus electrode arranged successively in alignment with said cathodes for focusing said electron beams, means for applying appropriate voltages to said control grid, said screen grid and as first and second electrodes of said main lens, said control grid, said screen grid and said main electron lens each having three spaced-apart, aligned apertures comprising a center aperture and two outer apertures disposed in a plane for passing the electron beams, said screen grid having a first surface directed toward said control grid and a second surface directed toward said main electron lens, said screen grid including a functional grid region including the screen grid apertures, asymmetric beam focusing means, and refraction lens means, the improvement wherein said asymmetric beam focusing means comprises a transversely disposed rectangularly-shaped slot formed in said first surface of said functional grid region to provide a two-part crossover of said electron beams, said slot having a length greater than the spacing between the outer screen grid apertures, and a width greater than the diameter of the screen grid apertures, the screen grid apertures being substantially circularly-shaped to provide symmetric pre-focusing of the beams entering said main electron lens, and said refraction lens means comprises a transversely disposed recessed portion formed in said second surface of said functional grid region to provide a compensating field between said screen grid and said first focus electrode of said main electron lens to offset any changes in said main electron lens caused by variations in focus voltage on said first focus electrode, said recessed portion including a substantially rectangularly-shaped central part and substantially triangularly-shaped end parts, the apex of each of the triangularly-shaped end parts being smoothly curved, said recessed portion having a length, extending in the plane of said electron beams, substantially coextensive with the length of said slot, and a width, extending substantially orthogonal to said plane of said electron beams, substantially greater than the width of said slot, said screen grid apertures extending into said recessed portion of said screen grid, said recessed portion being surrounded by a substantially perpendicular peripheral rim which conforms to the shape of said recessed portion, the central part of said peripheral rim being remote from the center screen grid aperture and the triangularly-shaped end parts of said rim being in proximity to the outer screen grid apertures, thereby affecting the electrostatic field in the vicinity of the outer beam paths by tilting the field lines within said recessed portion.

* * * * *

UNITED STATES PATENT AND TRADEMARK OFFICE

CERTIFICATE OF CORRECTION

PATENT NO. : 4,608,515

DATED : August 26, 1986

INVENTOR(S) : Hsing-Yao Chen

It is certified that error appears in the above-identified patent and that said Letters Patent is hereby corrected as shown below:

Patent

Col. 1, line 32
change "other to --outer--;

Col. 7, line 18
change "the" first occurrence to --The--.

Signed and Sealed this

Eleventh Day of November, 1986

*Attest:*

DONALD J. QUIGG

*Attesting Officer* *Commissioner of Patents and Trademarks*